US006007500A

United States Patent [19]

Quintinskie, Jr.

[11] Patent Number: 6,007,500

[45] Date of Patent: Dec. 28, 1999

[54] SHOULDER, ROTATOR CUFF, AND ELBOW STRETCHING MACHINE

[76] Inventor: John J. Quintinskie, Jr., 31025 5th Ave. South, Federal Way, Wash. 98003

[21] Appl. No.: 09/014,967

[22] Filed: Jan. 28, 1998

[51] Int. Cl.[6] ..... A61H 1/00; A61H 1/02

[52] U.S. Cl. ..... 601/5; 601/33; 601/84

[58] Field of Search ..... 601/23, 33, 5, 601/84, 136; 128/877, 881; 482/133, 905, 907, 908, 46, 44, 131; 602/32, 36, 16, 21

[56] References Cited

U.S. PATENT DOCUMENTS

| | | | |
|---|---|---|---|
| 3,013,799 | 12/1961 | Wise . | |
| 3,089,700 | 5/1963 | Hotas . | |
| 3,614,108 | 10/1971 | Garten . | |
| 4,669,451 | 6/1987 | Blauth et al. | 601/33 |
| 4,708,178 | 11/1987 | Ancillotti . | |
| 4,878,663 | 11/1989 | Luquette | 272/134 |
| 4,957,281 | 9/1990 | Chrotokar, Jr. . | |
| 5,163,451 | 11/1992 | Grellas . | |
| 5,179,939 | 1/1993 | Donovan et al. | 601/33 |
| 5,250,016 | 10/1993 | Higgins . | |
| 5,391,132 | 2/1995 | Greenwald | 482/91 |
| 5,417,643 | 5/1995 | Taylor | 601/33 |
| 5,645,521 | 7/1997 | Hepburn et al. | 601/33 |
| 5,685,830 | 11/1997 | Bonutti | 602/23 |
| 5,800,366 | 9/1998 | Bertrand | 601/24 |
| 5,848,979 | 12/1998 | Bonutti et al. | 601/5 |

FOREIGN PATENT DOCUMENTS

| | | | |
|---|---|---|---|
| 1671296 | 8/1991 | U.S.S.R. | 601/33 |

*Primary Examiner*—Richard J. Apley
*Assistant Examiner*—Justin R. Yu
*Attorney, Agent, or Firm*—David L. Tingey

[57] ABSTRACT

A rotator cuff stretching machine with pivoting members provides for simultaneously stretching of the rotator cuff, shoulder and elbow in selective upper arm positions of yaw and pitch angles and selective elbow positions of flexion or extension. The apparatus adjusts to allow internal and external rotation stretching of the shoulder at levels of abduction from 45 degrees to 100 degrees and allows that stretch to be accomplished at various levels of horizontal adduction and abduction. The apparatus comprises an arm assembly which includes a forearm assembly for receiving a forearm of the user pivotably joined to an upper arm assembly for receiving the corresponding upper arm of the user. The arm assembly is attached to a rotating assembly so that rotation of the rotating assembly causes the arm assembly to rotate. The rotation assembly and attached arm assembly is attached to a vertical support that rotates in horizontal yaw on a vertical yaw pivot pin. This rotation produces horizontal adduction and abduction of the shoulder and arm assembly. The arm assembly is pivotably connected to the rotating assembly with a pitch pivot joint that allows the upper arm assembly to alter its pitch angle. The arm assembly also is adjustable to the length of upper arm.

20 Claims, 7 Drawing Sheets

SHOULDER, ROTATOR CUFF, AND ELBOW STRETCHING MACHINE

FIELD OF THE INVENTION

The present invention relates to devices for passively stretching the shoulder specifically musculature of the rotator cuff and the joint capsule and methods for doing the same.

BACKGROUND OF THE INVENTION

The rotator cuff of the shoulder is a group of four muscles that are primarily responsible for internal and external rotation of the arm and shoulder. This muscle group is very prone to injury from overhead throwing, lifting and various activities performed overhead. The lack of flexibility of the rotator cuff is a primary cause of many of these injuries. Stretching these tissues correctly is the way to prevent and or rehabilitate injuries and increase range of motion of these joints, and their associated connective tissues.

The optimal way to stretch a muscle is to do so without causing contraction of the stretched muscle. This can only be accomplished by performing passive static stretching. This method allows stretching force to be applied to the connective tissue of the muscle without causing active bonding of the contractile components. Longtime use of this method of stretching breaks down scar tissue and adhesions and stimulates the healing process of the connective tissue. This results in elongation of the connective tissue fibers which are also less rigid and more elastic. Carefully controlling the amount of tension applied to these tissues during stretching is the safest method. This makes the tissue less likely to reach its end point of flexibility during the stretch-contraction cycle and consequently less prone to tearing and injury.

The rotator is not easily stretched correctly with the arm abducted around 90 degrees, which is the position employed by previously-existing exercisers. Abduction of a shoulder with impingement syndrome causes the supraspinatus muscle of the rotator cuff to contract. When this occurs during stretching it is less effective as a stretch and could possibly irritate or further injure the muscle. One way to stretch the rotator cuff and shoulder into external or internal rotation while putting less stress on the cuff is to move the arm into horizontal adduction. Another way to reduce impingement and stress on the shoulder during internal and external rotation, is to decrease the amount of abduction the arm is placed in while stretching.

Stretching the arm when it is abducted at 90 degrees and internally or externally rotated also puts a stretch on the tissues of the elbow. Having a device that would allow the arm to be extended while in these positions would allow the user to maintain the stretch on the shoulder while changing the forces on the elbow to that which would be pain free and beneficial. When the shoulder is stretched with the elbow bent at 90 degrees, pain may be caused at the elbow which prevents the appropriate level of stretch on the shoulder. Extending the elbow (straight) allows the shoulder to be stretched in this circumstance because the elbow pain will be eliminated. Also, for persons with elbow tendonitis (i.e., tennis elbow, little league elbow), stretching the elbow into proration and supination with the elbow extended (straight at 180 degrees) is beneficial in treating elbow tendonitis.

A currently-used method for stretching the rotator cuff into internal and external rotation while the arm is abducted is to lie on one's back on the edge of a table and let the forearm hang over the edge, while holding a weight in ones' hand. While this stretches the muscles, the weight applies a force against the muscles, which may or may not be the exact level of tension needed to produce a beneficial stretch. This stretch applied to a contracting muscle would be more likely to cause injury, and provide a less effective stretch on the connective tissue. The foregoing method is much more easily applied to the movement of external rotation than internal rotation. Internal rotation done using the above method allows much more movement of the scapula. This would make the likelihood of active contraction during the internal rotation stretching process greater. Another similar method is to have another person hold the arm abducted while moving the forearm into internal and external rotation.

Another method used to stretch the rotator cuff requires the assistance of another person. A partner places the arm in the 90° abducted position, while the user to be stretched lies on the user's back, or is standing. This method has two drawbacks. The first is that a second person is required and the second is that the person applying this force must be very responsive to feedback from the user about the intensity of the stretch. Too much pressure can very easily injure the rotator cuff. Therefore, the user being stretched does not have complete control over the force of the stretch being applied. In other words, the user is required to place his or her injured and sore arm, as well as his or her complete trust, in a therapist's hands. This is particularly a difficult situation, especially in the beginning of a therapy program. Patients tend to guard their muscles during the stretching, resulting in non-voluntary contractions of the muscles being stretched. This can be very painful for the user and frustrating for the therapist. Oftentimes, extended periods are required to do a few short stretches.

Currently, there are devices that are used to increase range of motion of the shoulder known as constant passive motion machines (CPM). These are motorized devices that attach to a chair and are used by physicians after shoulder surgery and manipulations of frozen shoulders. Certain CPM devices can initiate shoulder flexion and abduction as well as combining abduction with external rotation. However, these devices do not allow the user to move into selective levels of horizontal adduction or extend the elbow. These devices also use motors to provide movement and not direct application and control by physical means the user.

There are also a number of machines that strengthen the shoulder and rotator cuff with the arm at 90 degrees of abduction and the elbow flexed at 90 degrees. However, those machines apply resistance via weight plates against gravity. This does not allow the user to control the amount of stretch or tension being applied to the musculature. It is determined by the amount of weight that has been previously loaded onto the machine. This could be more or less than the amount that is beneficial which amount is best measured only by the user during use. A machine that is designed to provide the exact amount of tension in positions that are comfortable and physiologically safe under the current level of injury to the shoulder would provide a better method of prevention and rehabilitation of shoulder and elbow injuries.

It is therefore the object of the present invention to provide a machine for increasing flexibility that can place the user in various levels of abduction, horizontal adduction, internal and external rotation and elbow flexion or extension at the same time. It is a further object that the machine simultaneously stretch the rotator cuff, shoulder and elbow in selective positions. It is another object that the machine provide the user with complete control of the intensity of stretch via self-imposed manual means that places the shoulder and elbow in positions that allow the stretch to be done when other positions would be painfull and therefore not performable. It is yet another object that the machine be adapted to rehabilitate elbow tendonitis by applying proration and supination (internal and external rotation of the forearm) at the proper intensity. It is a final object that the machine be usable to treat elbow problems as well as shoulder problems, or allow treatment of one area when pain in the other prevents certain therapeutic stretching.

SUMMARY OF THE INVENTION

These and other objects are realized in the apparatus of the present invention that adjusts to allow internal and external rotation stretching of the shoulder at levels of abduction from 45 degrees to 100 degrees and allows that stretch to be accomplished at various levels of horizontal adduction and abduction. It will also adjust to allow the elbow to be extended or flexed while performing the above mentioned movements.

The apparatus comprises an arm assembly which includes a forearm assembly for receiving a forearm of the user and an upper arm assembly for receiving the corresponding upper arm of the user. These upper and forearm assemblies are pivotably joined to allow the user's elbow to extend or flex. The arm assembly is attached to a rotating assembly so that rotation of the rotating assembly causes the arm assembly to rotate. The rotating assembly includes a bearing having a rotational axis that is centered along the longitudinal axis of the upper arm when placed in the arm assembly. The bearing has rotational capacity of 360 degrees. The rotation assembly and attached arm assembly is attached to a vertical support that rotates in horizontal yaw on a vertical yaw pivot pin. This rotation produces horizontal adduction and abduction of the shoulder and arm assembly.

A control assembly is provided for allowing the user to manually apply control of the degree of rotation of the rotating assembly during the stretching session. A linkage assembly connects the control assembly to the rotating assembly. Using the control assembly during a stretching session, the user is able to control the degree of rotation of the rotating assembly, and thus the intensity of the stretching, particularly near the maximum external and internal positions of rotation. The control assembly is provided in a position so that the user can manipulate the control assembly with the free hand during a stretching session Accordingly, the user is not required to dismount the apparatus in order to increase or decrease the force being used to stretch the rotator cuff. By allowing the user to control the amount of tension being used to stretch the rotator cuff, anxieties and muscle contraction associated with having a therapist or other currently used techniques to stretch the rotator cuff are reduced. Furthermore, since the user has reduced anxiety, it is much easier to perform multiple stretches in a short period of time.

The arm assembly is pivotably connected to the rotating assembly with a pitch pivot joint that allows the upper arm assembly to alter its pitch angle. This pitch pivot joint has a locking pin that fixes the angle of the arm assembly in relation to the rotating assembly. The locking pin is not required and when not employed the level of abduction is adjustable at any time during stretching of the arm.

The arm assembly also is adjustable to the length of a user's upper arm. Adjustments of the arm assembly, in combination with the pitch pivot joint attached at the rotating assembly allow for the alterations in the level of shoulder abduction or angle of the arm assembly. The upper arm assembly includes 2 length-adjustable supports extending in parallel laterally from the rotating assembly comprising 2 sides of the upper arm assembly between which the user's forearm is secured by adjustable cuffs. Lengthening one upper arm assembly support relative to the other results in the alteration of the angle of abduction with the pivot point very near the shoulder. The length-adjustable support may comprise a first member telescoping from a second member with the width of the second member wider than that of the first member such that the first member can be disposed not in parallel with the second member.

The combination of the allowable movements of the forearm, upper arm and horizontal rotation enables one to simultaneously stretch the shoulder rotator cuff and elbow in safe and comfortable positions using static stretching techniques that cannot be done by other devices.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
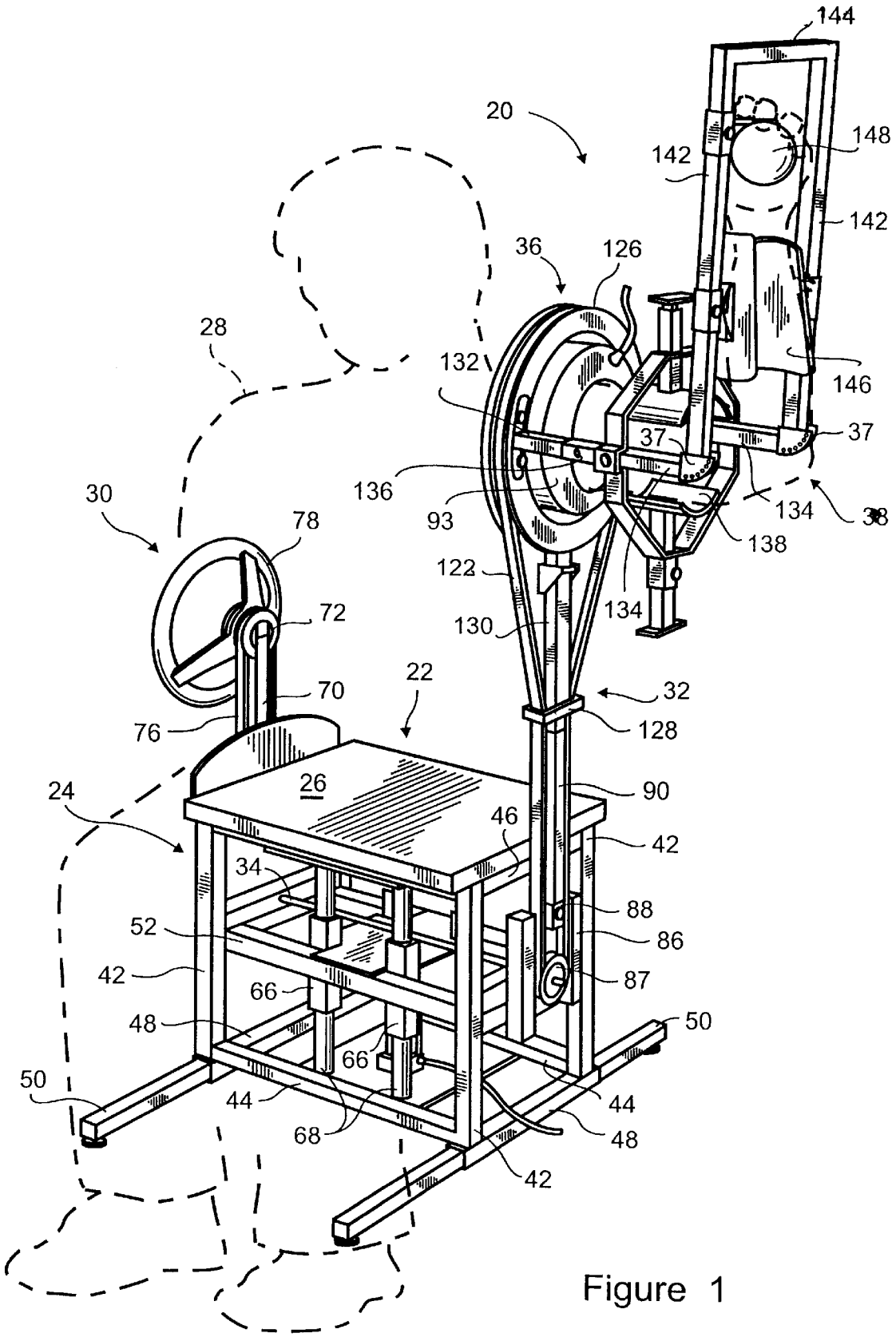
FIG. 1 is a perspective view (with user in phantom lines) of an apparatus formed in accordance with the present invention for stretching a rotator cuff into external rotation.
Figure 2:
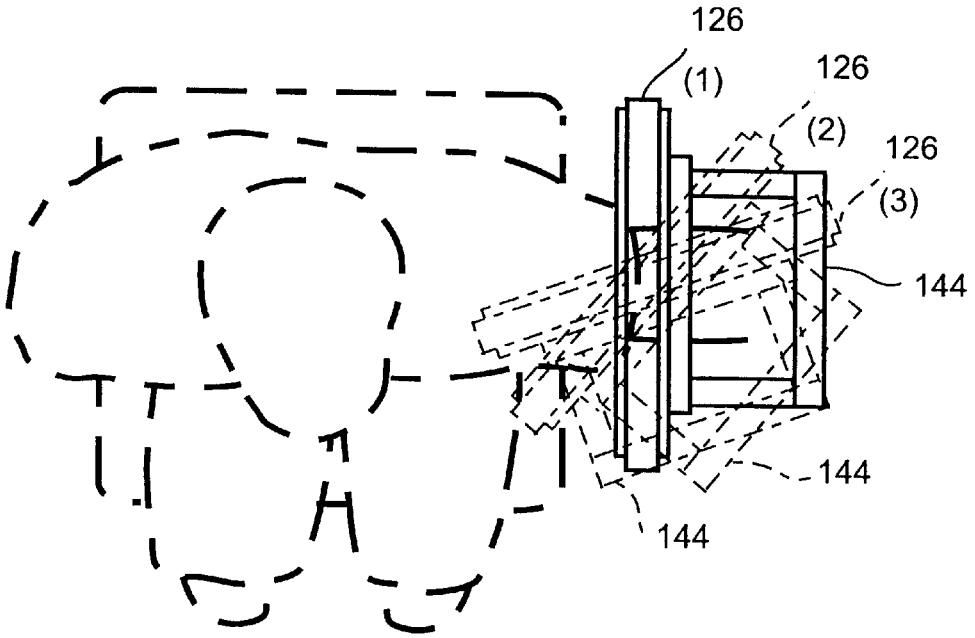
FIG. 2 is a top view showing three different positions as representative of possible in the level of adduction while in external rotation as a result of adjustments made to the upper arm assembly.
Figure 11:
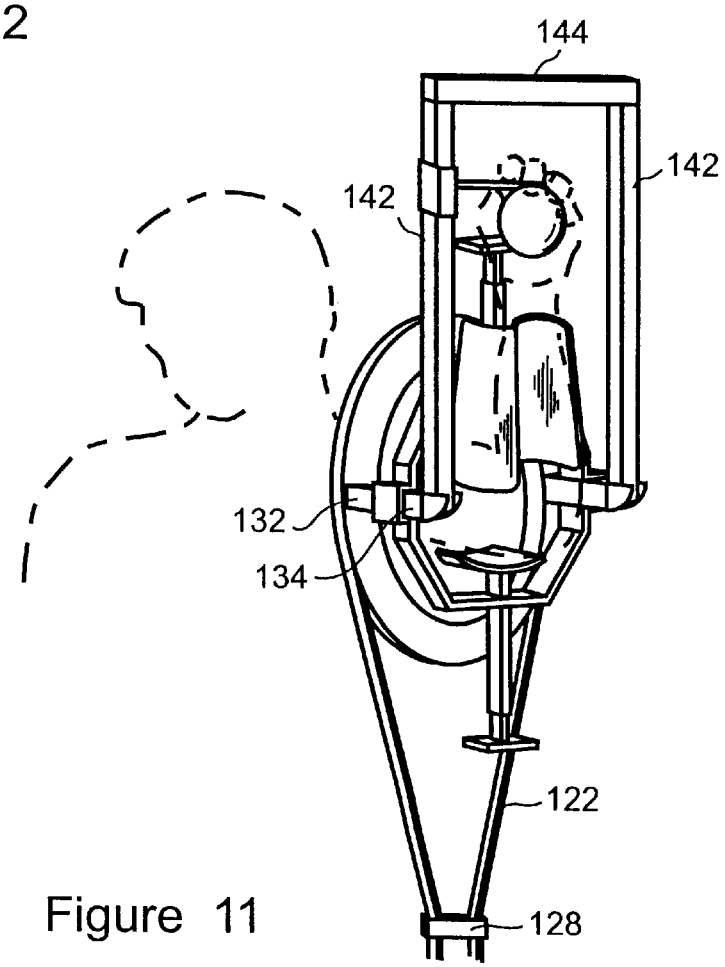
FIG. 11 is a perspective view of the machine in a position of forward horizontal adduction.
Figure 3:
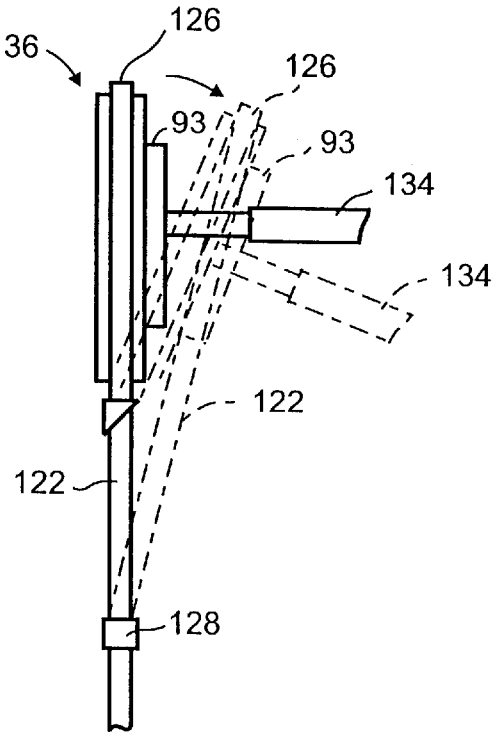
FIG. 3 is a front view showing changes in pitch angle of the machine allowing for changes in flexion or abduction.
Figure 4:
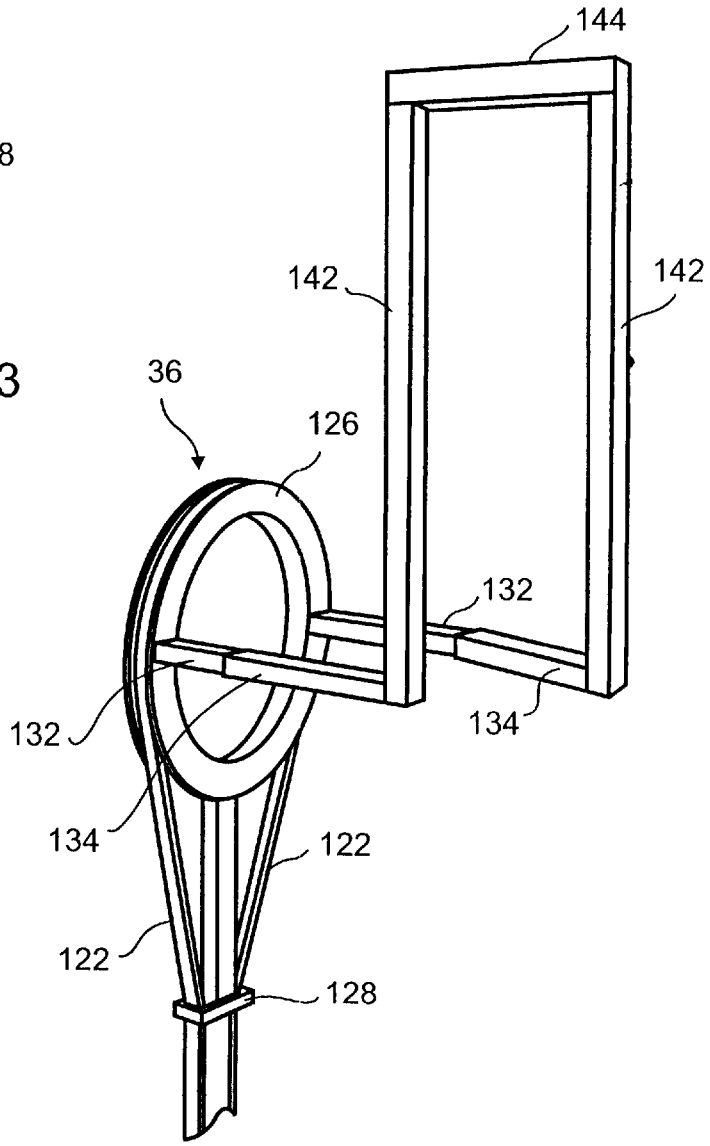
FIG. 4 is a perspective view of the apparatus as a result of changes made in the relative length adjustment of the parallel upper arm supports.
Figure 5:
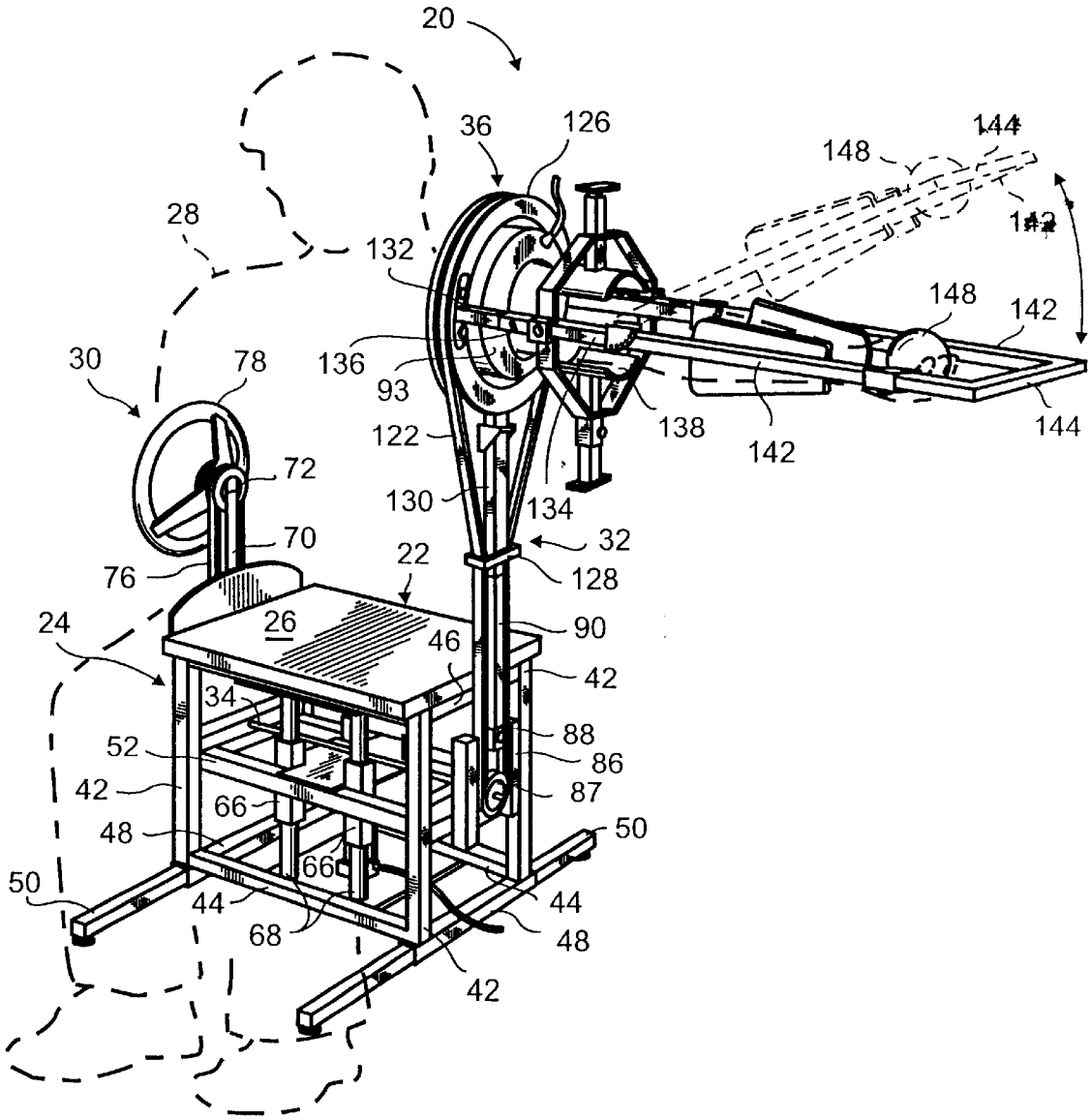
FIG. 5 is a perspective view of the machine showing the forearm assembly in full elbow parallel to the upper assembly, and a second selective position of elbow extension.
Figure 6:
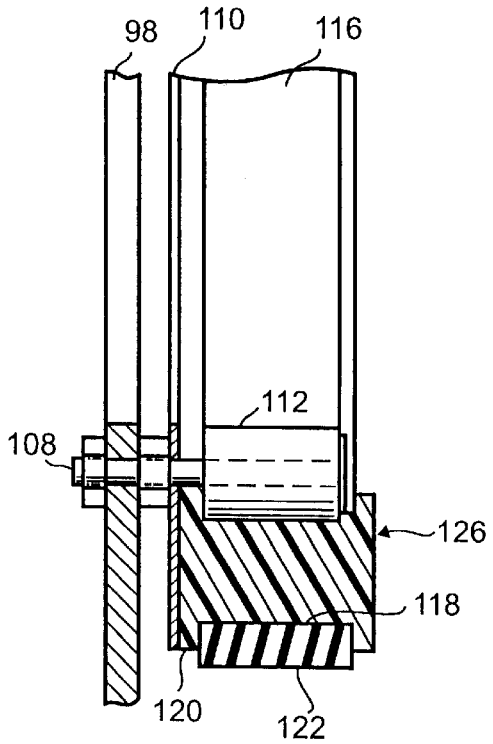
FIG. 6 is a sectional view of the bottom third of the rotating assembly.
Figure 7:
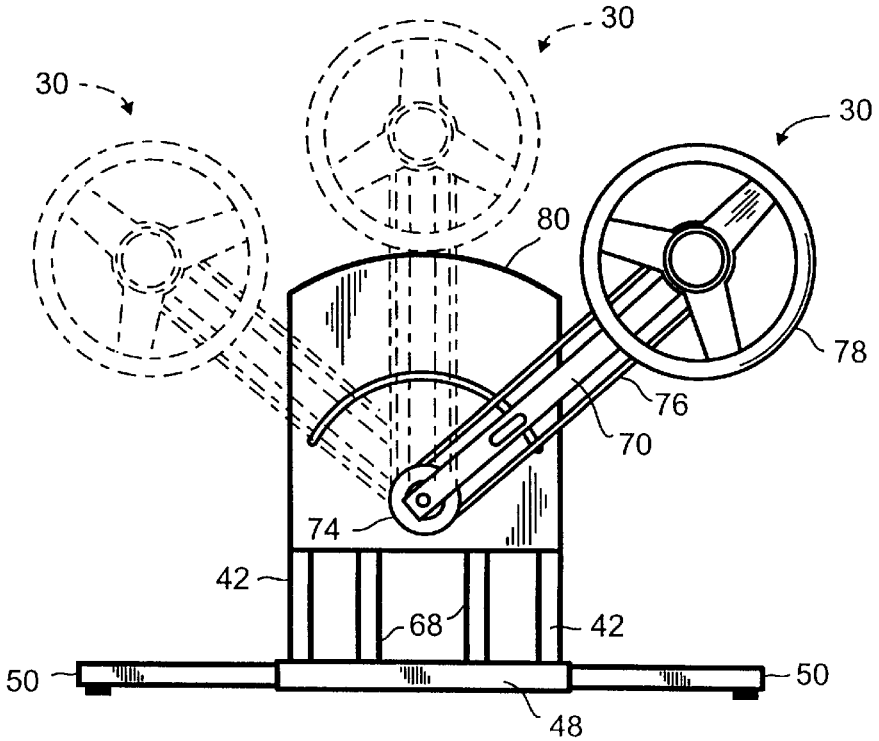
FIG. 7 is a partial view of the control side of the invention showing three of several possible positions of a control wheel.
Figure 8:
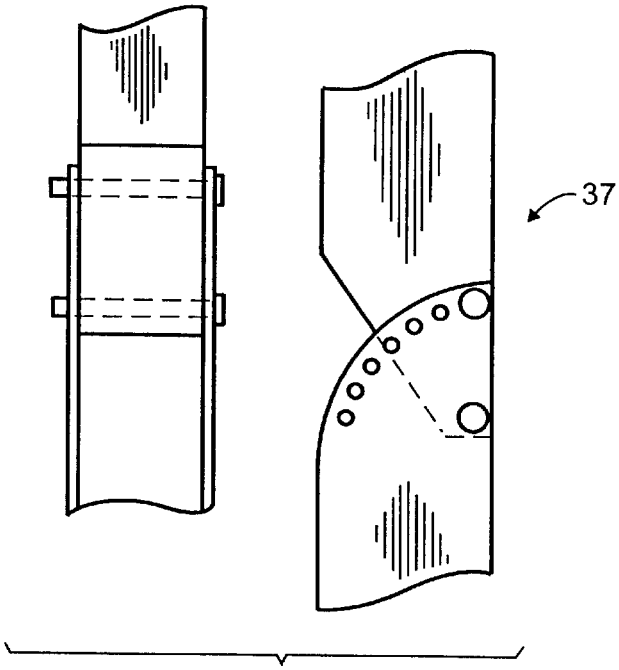
FIG. 8 is combined front and side view of a typical pivot joint with locking pin.
Figure 12:
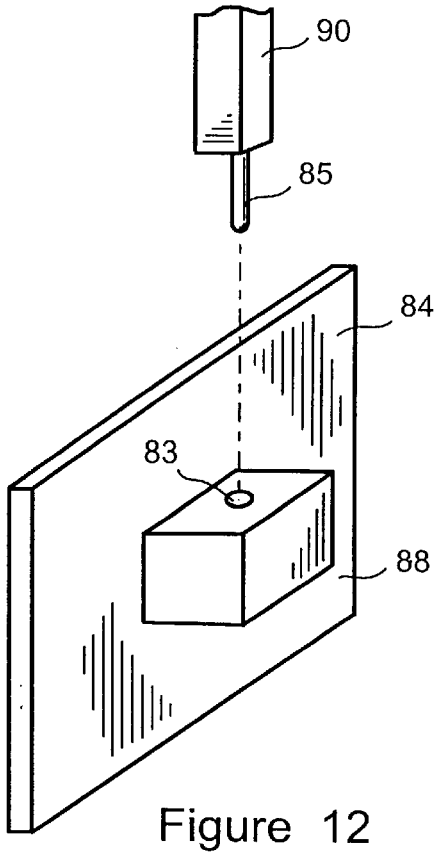
FIG. 12 is a perspective view showing a pivotal connector on which the support shaft rotates.
Figure 9:
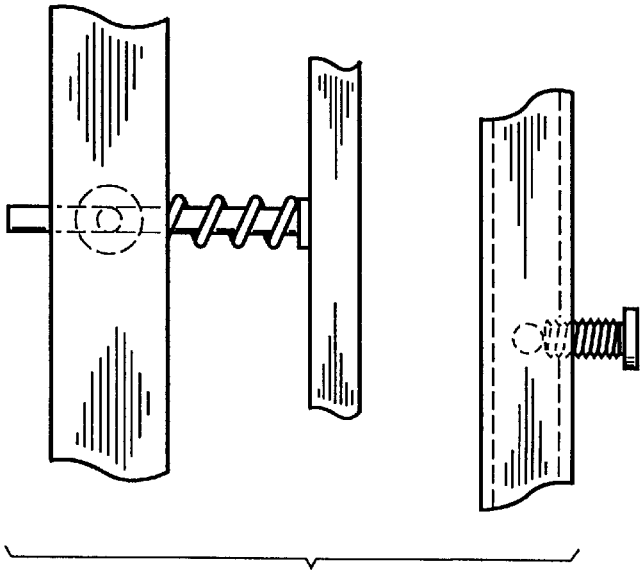
FIG. 9 is a combined front and side view of a typical spring-biased-cuff with adjustable position-securing bolt.
Figure 10:
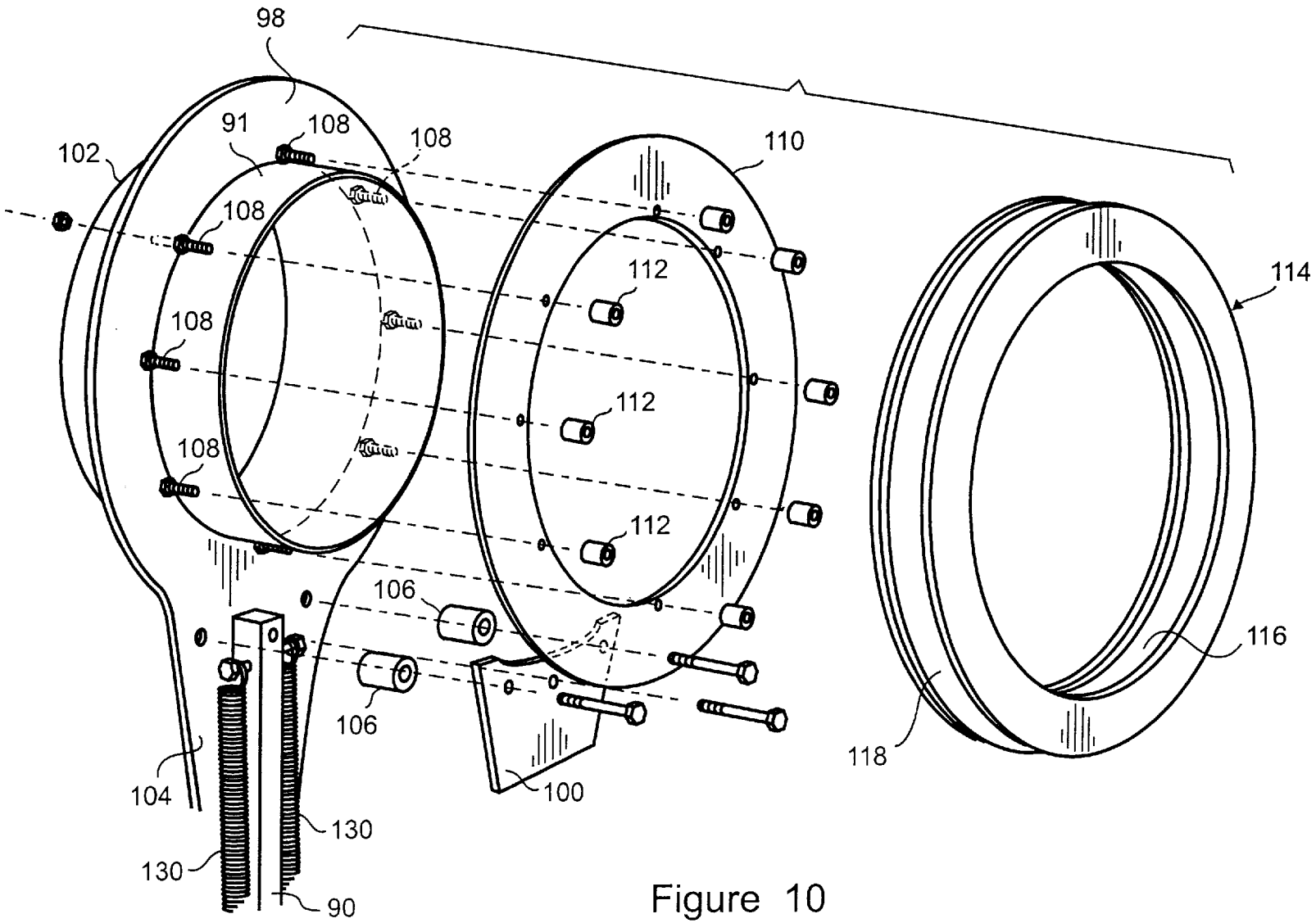
FIG. 10 is an exploded view of the rotating assembly.

Referring to FIG. 1, the stretching machine 20 includes a stationary base 22 that carries a floating frame 24. Stationary base 22 includes a seat 26 for a user 28. Floating frame 24 carries control assembly 30 and linkage assembly 32 at opposite ends. Control assembly 30 and the lower end of linkage assembly 32 are connected by a shaft 34 that extends through stationary base 22 and floating frame 24.

The upper end of the linkage assembly 32 supports a rotating assembly 36 through which the user's upper arm extends. Attached to the rotating assembly 36 is arm assembly 39 comprising upper arm assembly 38 that secures the upper arm of a user 28 in a substantially horizontal plane. The arm assembly 39 firther comprises forearm assembly 40 pivotably connected by locking pivot bracket 37 to the upper arm assembly 38 opposite the rotating assembly 36 for receiving the forearm of the user 28.

With user 28 seated on seat 26, the relative vertical position of control assembly 30, rotating assembly 36, upper arm assembly 38, and forearm assembly 40 can be adjusted by raising or lowering floating frame 24 relative to seat 26. User 28 inserts his or her arm through rotating assembly 36 and seats his or her upper arm in upper arm assembly 38 and his or her forearm in forearm assembly 40. By pivotably adjusting the angular position of the forearm assembly 40 relative to the upper arm assembly 38, the user's elbow is held in position at a selective position between 0 degrees and 100 degrees.

Stationary base 22 comprises an upright rectangular box within which floating frame 24 is supported for displacement in a vertical direction. In operation, when user 28 desires to elevate floating frame 24 and, accordingly, elevate all the assemblies attached thereto, he actuates a control (not shown) that causes the floating frame 24 to be lifted on the base frame, such as by means of a pneumatic piston 68. The vertical displacement of floating frame 24 is guided by vertical rectangular sleeves 66.

Secured to one end of shaft 34 is an end of elongate lever 70. On the opposite end of elongate lever 70 is rotatably secured pulley 72 which is connected by conventional belt 76 to pulley 74. Pulley 72 is rotatably connected to "steering wheel" 78 to allow user 28 to easily rotate the pulley 72. It should be understood that while in the illustrated embodiment, a pulley and belt system is depicted as a means for transferring rotation from wheel 78 to shaft 34, other conventional means such as sprockets and chains and the like can be used.

Secured onto the other end of shaft 34 is pulley 87. Directly above pulley 87 is pivotal connector 88 that is secured to the right-hand surface of housing plate 84. Extending downward and vertically into pivotal connector 88 is a bore 83 for pivotably receiving an end 85 of support shaft 90. A support pin 85 depends axially from the support shaft 90 and is received into the bore 83 of the pivotal connector 88 that allows support shaft 90 to rotate around its vertical axis as it is supported by the pivotal connector.

In the illustrated embodiment, above pivotal connector 88 is a belt tightening assembly 128 comprising a sliding member 96, through which a belt 122 passes and which slides on support shaft 90. A belt 122 is wrapped around rotating assembly 36 and pulley 87 and passes through the sliding member. The sliding member is secured on the support shaft in a selective position preferably by means of tension springs attached between the sliding member 96 and the support shaft 90. Because the rotating assembly over which the belt passes is larger than pulley 87, as the sliding member 96 is moved closer to the rotating assembly 36, the belt is tightened.

Rotating assembly 36 is secured to the upper end of support shaft 90 by sandwiching the upper end of support shaft 90 between a support frame 98 and a roller plate 100. The end of support shaft 90 opposite pulley 87 includes a bore passing left to right through support shaft 90 for receiving a securing bolt therethrough. Support rollers 106 are also sandwiched between the support frame and roller plate rotatably, each on bolts securing together the support frame and roller plate.

Support frame 98 includes a body that is generally circular in shape and includes a bore 102 passing through its center. Also included is a generally rectangular fastening arm 104 extending on the lower portion of the body of support frame 98 is a generally rectangular fastening arm 104 which includes three bores through which said bolts pass for securing the roller bolts and support shaft. Fastening arm 104 extends down along the length of support shaft 90 a distance sufficient to ensure that support frame 98 can be rigidly affixed to support shaft 90 without excessive torsional movement.

Situated within bore 102 is an annular ring 91 having an outer diameter substantially equal to the diameter of bore 102. Annular ring 91 serves as a housing for a shoulder cuff 93. Rotating assembly 36 further includes an annular friction plate 110 fitting over the annular ring 91 and an annular or toroidal bearing 114 having an outer diameter substantially equal to the outer diameter of the annular friction plate 110 next fitting over the shoulder cuff. The inner periphery of bearing 114 includes a groove 116 dimensioned to receive rollers 112 that are rollably secured to the friction plate which in turn is secured to the support frame on bolts 108 passing through bores in the annular friction plate 110 to support the rollers 112. In this manner, bearing 114 freely rides on rollers 112 that are supported by support frame 98. The outer periphery of bearing 114 includes a groove 118 that accepts a conventional "V" belt. Because of the stress exerted on bearing 114 during a stretching session, in addition to being supported by rollers 112, the outer periphery of bearing 114 also rests rollably on support rollers 106.

Bearing 114 also includes two sets of bores spaced 180 degrees apart for receiving means for connecting upper arm assembly 38 thereto as described below in more detail. It should be understood that while one embodiment of providing a rotating assembly has been illustrated with respect to a roller type of bearing, other types of bearing assemblies that provide for rotation around a centrally located axis can be used in accordance with the present invention.

The upper arm assembly 38 includes 2 length-adjustable supports diametrically opposed across the assembly bore 102 and extending in parallel laterally from the rotating assembly 36. The adjustable supports comprising 2 sides of the upper arm assembly between which the user's forearm is secured by typical adjustable cuffs 138 for stabilizing and centering a user's upper arm within upper arm assembly 38 after the user's arm is inserted through rotating assembly bore 102. Lengthening one upper arm assembly support relative to the other results in the alteration of the angle of abduction with the pivot point very near the shoulder. The adjustable supports include a pair of male bases 132 secured to the right-hand side of bearing 114 using any conventional means that does not interfere with the seating of belt 122 within the groove of bearing 114. Male bases 132 are generally tubular elements that extend perpendicularly from the right-hand face of bearing 114. Male bases 132 receive hollow tubular female elements 134 that slide over the ends of male bases 132. The combination of male bases 132 and tubular elements 134 provides a frame that has a variable length so that it can be extended relative to bearing 114 a distance sufficient to place the external ends thereof adjacent the elbow of a user. Adjustment of the relative position of tubular elements 134 with respect to male bases 132 is provided in a plurality of bores passing through male bases 132 and tubular elements 134 for receiving a pin 136 for securing the two together.

Pivotally connected to the ends of tubular elements 134 opposite bearing 114 is forearm assembly 40. Forearm assembly 40 includes two spaced-apart parallel elements 142, each having one end connected to a tubular female member 134 of the upper arm assembly. The opposite ends of Parallel elements 142 are joined by a transverse member 144. Slidably supported on elements 142 are upper and lower cups 146 for centering and securing the user's forearm by sandwiching it therebetween. Also provided on one of the elements 142 is an adjustable member 148 for gripping by the user's hand.

In operation, user 28 once seated on seat 26 positions the arm through bore 102 of rotating assembly 36 and secures the upper arm in upper arm assembly 38 and the forearm in forearm assembly 40. When thus positioned, the upper arm may be abducted in approximately a 90-degree position, and the forearm may be in a 90-degree position relative to the upper arm. When such is not a preferred arm orientation, the upper arm may be in virtually any comfortable position, combining the vertical, or pitch, adjustment of the rotating assembly and its horizontal, or yaw, adjustment. In order to stretch the user's rotator cuff, the user uses control assembly 30 to rotate rotating assembly 36 and his or her upper arm internally or externally from a neutral position. This rotation should be limited internally and externally by the comfortable tightness of the user's muscles. Once a user 28 is positioned in the machine 20, he or she uses the control assembly 30 to rotate the upper arm and forearm to a position of maximum comfortable tightness without eliciting pain. This stretching of the rotator cuff is controlled by control assembly 30 which through linkage assembly 32 rotates, rotating the rotating assembly 36. This controlled rotation of rotating assembly 36 is transferred to the user's upper arm and forearm through upper arm assembly 38 and forearm assembly 40. Accordingly, the stretching of the rotator cuff is under the direct control of the user during the stretching session. Accordingly, user 28 can increase or decrease the tension on the rotator cuff immediately by increasing or decreasing the rotation of the control assembly 30. As shown in the figures, the user can position the arm relative to the user's body in a number of angular positions, including horizontal abduction and vertical adduction, as depicted by the phantom lines. Because user 28 has direct control of the extent of rotation of rotating assembly 36 and consequent stretching of the rotator cuff, the anxiety level and pain threshold is under the user's direct control. Once the rotator cuff has been stretched in the external direction, the user simply reverses wheel 78 of control assembly 30 which rotates the arm internally down to the lowermost comfortable position. This lowermost position corresponds to a position of maximum comfortable tightness without eliciting pain. As with stretching of the rotator cuff in the internal direction, user 28 employs control assembly 30 to directly control the stretching in the external direction.

The apparatus of the present invention is different from motorized types of constant passive motion machines in that it provides the user with complete control as to the degree and the time at which the external force is applied to the arm to stretch the rotator cuff. This is quite reassuring for the user who typically is distrustful of exercise machines or therapists, particularly when pain is involved.

The utilization of an apparatus formed in accordance with the present invention and the method formed in accordance with the present invention provides several advantages. For example, the device is very simple and inexpensive to manufacture. It allows the user to completely control the intensity of the stretch. It also places the shoulder in a throwing-type position which is preferable when the user intends to rehabilitate or train for throwing events. The device is also easily adjustable to any size of person and it allows for the complete relaxation of the stretched muscle. Perhaps the most significant improvement offered by the present machine is its capability to accept the user's forearm in a position beginning at virtually any angular orientation with the forearm also at virtually any angle of elbow extension, therein offering the injured user an initial arm position best suited for his rehabilitation.

While the preferred embodiment of the invention has been illustrated and described, it will be appreciated that various changes can be made therein without departing from the spirit and scope of the invention.

Having described the invention, what is claimed is as follows:

1. A rotating cuff stretching machine for passively stretching a rotator cuff of a user whose arm, comprising an upper arm with a longitudinal axis, is placed in the machine, comprises:

an arm assembly with an axis for receiving said upper arm of the user such that the upper arm axis when placed on the arm assembly is coaxial with the arm assembly axis;

a rotating assembly having a horizontal rotational axis, the arm assembly connected to the rotating assembly with the arm assembly axis coaxial with the rotating assembly rotational axis such that said rotating assembly axis causes the arm assembly and user's upper arm when placed therein to rotate about the rotational assembly axis;

a control assembly connected to the rotating assembly such that rotation of the rotating assembly is controlled by rotation of the control assembly; and a rotating assembly support means for supporting the rotating assembly, a horizontal pivot joint at a rotating assembly support means first end; the rotating assembly attached such that the pivoting rotating assembly pivots on a horizontal axis with the rotating assembly thereby providing a pitch angle adjustment of the rotating assembly on the support means.

2. The machine of claim 1 in which said arm assembly further comprises an upper arm subassembly connected to the rotating assembly and a forearm subassembly connected pivotably to the upper arm subassembly at an elbow position such that with said user's arm in the arm assembly the user's elbow can be positioned in the arm assembly at a selective angle of flexion or extension.

3. The machine of claim 2 further comprising means in the rotating assembly support means for pivoting the rotating assembly on a vertical axis such that the rotating assembly is adjustable in yaw angle.

4. The machine of claim 1 further comprising means in the rotating assembly support means for pivoting the rotating assembly on a vertical axis such that the rotating assembly is adjustable in yaw angle.

5. A rotating cuff stretching machine for passively stretching a rotator cuff of a user whose arrn, comprising an upper arm with a longitudinal axis, is placed in the machine, comprises:

an arm assembly with an axis for receiving said upper arm of the user such that the upper arm axis when placed on the arm assembly is coaxial with the arm assembly axis;

a rotating assembly having a horizontal rotational axis, the arm assembly connected to the rotating assembly with the arm assembly axis coaxial with the rotating assembly rotational axis such that its axis causes the arm assembly and user's upper arm when placed therein to rotate about the rotational assembly axis;

a control assembly connected to the rotating assembly such that rotation of the rotating assembly is controlled by rotation of the control assembly; and a rotating assembly support means for supporting the rotating assembly, a vertical pivot joint disposed in the rotating assembly support means such that the rotating assembly pivots on the vertical pivot joint on a vertical pivot joint vertical axis with the rotating assembly thereby providing a yaw angle adjustment of the rotating assembly on the support means.

6. A rotating cuff stretching machine for passively stretching a rotator cuff of a user whose arm, comprising an upper arm with a longitudinal axis, is placed in the machine, comprises:

an arm assembly with a rotational axis, for receiving said upper arm of the user such that the upper arm longitudinal axis when placed on the arm assembly is coaxial with the arm assembly rotational axis;

a rotating assembly having a horizontal rotational axis, the arm assembly connected to the rotating assembly with the arm assembly axis coaxial with the rotating assembly rotational axis such that said rotating assembly axis causes the arm assembly and user's upper arm when placed therein to rotate about the rotational assembly axis;

a control assembly connected to the rotating assembly such that rotation of the rotating assembly is controlled by rotation of the control assembly; and a rotating assembly support means for supporting the rotating assembly, said arm assembly further comprising an upper arm subassembly connected to the rotating assembly and a forearm subassembly connected pivotably to the upper arm subassembly at an elbow position such that with said user's arm in the arm assembly the user's elbow can be positioned in the arm assembly at a selective angle of flexion or extension to achieve an effective stretch on the user's shoulder while changing the forces on the user's elbow to forces pain free and beneficial.

7. The machine of claim 6 further comprising means in the rotating assembly support means for pivoting the rotating assembly on a vertical axis such that the rotating assembly is adjustable in yaw angle.

8. The machine of claim 6 in which the upper arm assembly further comprises two length-adjustable supports extending in parallel laterally from the rotating assembly defining two sides of the upper arm assembly between which said user's upper arm is secured such that the upper arm assembly can be lengthened or shortened to match said user's upper arm.

9. The machine of claim 6 in which the upper arm subassembly further comprises two length-adjustable supports extending in parallel laterally from the rotating assembly defining two sides of the upper arm subassembly between which said user's upper arm is secured such that the upper arm subassembly can be lengthened or shortened to match said user's upper arm, each upper arm subassembly side adjustable in length independently of the other side such that length adjustments of one upper arm subassembly support relative to the other upper arm subassembly support results in alteration of the angle of abduction relative to the rotating assembly, pivoting near said user's shoulder.

10. A rotating cuff stretching machine for passively stretching a rotator cuff of a user whose arm is placed in the machine, comprising:

an arm assembly with an axis for receiving said upper arm of the user such that the upper arm axis when placed on the arm assembly is coaxial with the arm assembly axis, a rotating assembly having a horizontal rotational axis, the arm assembly connected to the rotating assembly with the arm assembly axis coaxial with the rotating assembly rotational axis such that said rotating assembly axis causes the arm assembly and user's upper arm when placed therein to rotate about the rotational assembly axis, the rotating assembly including a toroidal bearing having a large axial bore therethrough for receiving the arm of the user with its rotational axis centered along the longitudinal axis of the user's upper arm when placed in the machine, a control assembly connected to the rotating assembly for allowing the user to control the degree of rotation of the rotating assembly during rotation thereof, a rotating assembly support means supporting the rotating assembly on a rotating assembly means first end.

11. The machine of claim 10 further comprising a horizontal pivot joint on the rotating assembly support means first end to which the rotating assembly is attached such that pivoting rotating assembly pivots on a horizontal axis with the rotating assembly thereby providing a pitch angle adjustment of the rotating assembly on the support means.

12. The machine of claim 10 further comprising said arm assembly further comprising an upper arm subassembly connected to the rotating assembly and a forearm subassembly connected pivotably to the upper arm subassembly at an elbow position such that with said user's arm in the arm assembly the user's elbow can be positioned in the arm assembly at a selective angle of flexion or extension to achieve an effective stretch on the user's shoulder while changing the forces on the user's elbow to forces pain free and beneficial.

13. The machine of claim 10 further comprising a vertical pivot joint included in the rotating assembly support means adapted such that the rotating assembly pivots on the vertical pivot joint on a vertical pivot joint vertical axis with the rotating assembly thereby providing a yaw angle adjustment of the rotating assembly on the support means.

14. A rotating cuff stretching machine for passively stretching a rotator cuff of a user whose arm is placed in the machine the improvement comprising:

an arm assembly with an axis for receiving said upper arm of the user such that the upper arm axis when placed on the arm assembly is coaxial with the arm assembly axis, a rotating assembly having a horizontal rotational axis, the arm assembly connected to the rotating assembly with the arm assembly axis coaxial with the rotating assembly rotational axis such that said rotating assembly axis causes the arm assembly and user's upper ann when placed therein to rotate about the rotational assembly axis, the rotating assembly including a toroidal bearing having a large axial bore therethrough for receiving the arm of the user with its rotational axis centered along the longitudinal axis of the user's upper arm when placed in the machine, a control assembly connected to the rotating assembly for allowing the user to control a degree of rotation of the rotating assembly during rotation thereof, a rotating assembly support means supporting the rotating assembly, a horizontal pivot joint at a rotating assembly support means first end the rotating assembly is attached such that pivoting rotating assembly pivots on a horizontal axis with the rotating assembly thereby providing a pitch angle adjustment of the rotating assembly on the support means, said arm assembly further comprising an upper arm subassembly connected to the rotating assembly and a forearm subassembly connected pivotably to the upper arm subassembly at an elbow position such that with said user's arm in the arm assembly the user's elbow can be positioned in the arm assembly at a selective angle of flexion or extension to achieve an effective stretch on the user's shoulder while changing the forces on the user's elbow forces pain free and beneficial, a vertical pivot joint included in the rotating assembly support means such that the rotating assembly pivots on the vertical pivot joint on a vertical pivot joint vertical axis with the rotating assembly yaw angle thereby providing a yaw angle adjustment of the rotating assembly on the support means.

15. A rotating cuff stretching machine for passively stretching a rotator cuff of a user whose arm is placed in the machine, comprising:

an arm assembly with an axis for receiving said upper arm of the user such that the upper arm axis when placed on the arm assembly is coaxial with the arm assembly axis, a rotating assembly having a horizontal rotational axis, the arm assembly connected to the rotating assembly with the arm assembly axis coaxial with the rotating assembly rotational axis such that said rotating assembly axis causes the arm assembly and user's upper arm when placed therein to rotate about the rotational assembly axis, the rotating assembly including a toroidal bearing having a large axial bore therethrough for receiving the arm of the user with its rotational axis centered along the longitudinal axis of the user's upper arm when placed in the machine, a control assembly connected to the rotating assembly for allowing the user to control the degree of rotation of the rotating assembly during rotation thereof, a rotating assembly support means supporting the rotating assembly, the rotating assembly further including a frame having a bore passing through its center and comprising a fastening arm extending on a lower portion of the body of support frame for supporting support rollers, support rollers rollably secured between the fastening arm and the support frame, an annular ring situated within said bore and having an outer diameter substantially equal to a diameter of said bore, a shoulder cuff within said bore, an annular friction plate fitting over the annular ring, said toroidal bearing fitting over the annular ring, an outer periphery of said bearing including a groove that accepts a belt, and an inner periphery of bearing disposed to receive bearing rollers that are rollably secured to the friction plate which in turn is secured to the support frame such that said bearing freely rides on said bearing rollers.

16. The machine of claim 15 further comprising two supports diametrically opposed across said bore and extending in parallel laterally from the rotating assembly toroidal bearing, the adjustable supports comprising two sides of said arm assembly and comprising an upper arm assembly therein between which the user's forearm is secured after the user's arm is inserted through said rotating assembly bore.

17. The machine of claim 15 in which the arm assembly further comprises a forearm assembly which includes two spaced-apart parallel elements, each having one end pivotably connected to a support of the upper arm assembly.

18. A rotating cuff stretching machine for passively stretching a rotator cuff of a user whose arm is placed in the machine, comprising:

an arm assembly with an axis for receiving said upper arm of the user such that the upper arm axis when placed on the arm assembly is coaxial with the arm assembly axis, a rotating assembly having a horizontal rotational axis the arm assembly connected to the rotating assembly with the arm assembly axis coaxial with the rotating assembly rotational axis such that said rotating assembly axis causes the arm assembly and user's upper arm when placed therein to rotate about the rotational assembly axis, the rotating assembly including a toroidal bearing having a large axial bore therethrough for receiving the arm of the user with its rotational axis centered along the longitudinal axis of the user's upper arm when placed in the machine, a control assembly connected to the rotating assembly adapted to impart rotation to the rotating assembly and control the degree of rotation of the rotating assembly during rotation thereof, a rotating assembly support means supporting the rotating assembly on a first rotating assembly support means end, a toroidal bearing belt means on said rotating assembly adapted to receive a belt, a pulley through which said control assembly controls rotation of the rotating assembly, the pulley disposed on a second support means end adapted to receive a belt, a belt looped between the toroidal bearing belt means and the pulley wherein the pulley is of diameter smaller than the annular bearing means over which the bell is looped, a slide slidably mounted on the rotating assembly support means through which said belt passes, means to maintain said slide at a selective position on the rotating assembly support means adapted to tighten the looped belt by sliding the slide toward the rotating assembly toroidal bearing belt means or to slacken the belt by sliding the slide toward the pulley.

19. A rotating cuff stretching machine for passively stretching a rotator cuff of a user whose arm is placed in the machine, comprising:

an arm assembly with an axis for receiving said upper arm of the user such that the upper arm axis when placed on the arm assembly is coaxial with the arm assembly axis, a rotating assembly having a horizontal rotational axis, the arm assembly connected to the rotating assembly with the arm assembly axis coaxial with the rotating assembly rotational axis such that said rotating assembly axis causes the arm assembly and user's upper arm when placed therein to rotate about the rotational assembly axis, the rotating assembly including a toroidal bearing having a large axial bore therethrough for receiving the arm of the user with its rotational axis centered along the longitudinal axis of the user's upper arm when placed in the machine, a control assembly connected to the rotating assembly adapted to impart rotation to the rotating assembly and control the degree of rotation of the rotating assembly during rotation thereof, a rotating assembly support means supporting the rotating assembly, said rotating assembly further comprising a frame having a bore passing through its center and comprising a fastening arm extending on a lower portion of the support frame for supporting support rollers, support rollers rollably secured between the fastening arm and the frame, an annular ring situated within said bore and having an outer diameter substantially equal to a diameter of said bore, a plurality of bearing rollers, said toroidal bearing fitting over the annular ring, the outer periphery of said bearing including a groove that accepts a belt, and the inner periphery of said toroidal bearing disposed to receive said bearing rollers rollably secured to the frame such that said bearing freely rides on said bearing rollers.

20. The rotating cuff stretching machine of claim 19 further comprising a friction plate secured to said frame over the annular ring between the frame and the toroidal bearing to which said rollers are rollably secured.

* * * * *